US010207898B2

(12) United States Patent
Kalliomäki

(10) Patent No.: US 10,207,898 B2
(45) Date of Patent: Feb. 19, 2019

(54) ELEVATOR

(71) Applicant: KONE Corporation, Helsinki (FI)

(72) Inventor: Jaakko Kalliomäki, Vantaa (FI)

(73) Assignee: KONE CORPORATION, Helsinki (FI)

( * ) Notice: Subject to any disclaimer, the term of this patent is extended or adjusted under 35 U.S.C. 154(b) by 1128 days.

(21) Appl. No.: 14/548,162

(22) Filed: Nov. 19, 2014

(65) Prior Publication Data

US 2015/0122588 A1 May 7, 2015

Related U.S. Application Data

(63) Continuation of application No. PCT/EP2013/061373, filed on Jun. 3, 2013.

(30) Foreign Application Priority Data

Jun. 22, 2012 (EP) ..... 12173201

(51) Int. Cl.
*B66B 5/00* (2006.01)
*B66B 7/06* (2006.01)
(Continued)

(52) U.S. Cl.
CPC ..... *B66B 7/068* (2013.01); *B66B 5/00* (2013.01); *B66B 5/0018* (2013.01); *B66B 7/10* (2013.01); *B66B 11/008* (2013.01)

(58) Field of Classification Search
CPC ..... B66B 7/068; B66B 11/008; B66B 5/12; B66B 7/06; B66B 7/10
See application file for complete search history.

(56) References Cited

U.S. PATENT DOCUMENTS 1,011,423 A * 12/1911 Gale ..... B66B 11/009 187/254
1,132,769 A 3/1915 Gale, Sr.
(Continued)

FOREIGN PATENT DOCUMENTS

CN 1094692 A 11/1994
EP 0 619 263 A2 10/1994
(Continued)

*Primary Examiner* — Diem M Tran
(74) *Attorney, Agent, or Firm* — Birch, Stewart, Kolasch & Birch, LLP

(57) ABSTRACT

An elevator has an elevator car and a counterweight suspended by hoisting ropes, which hoisting ropes are driven by a drive machine via a traction sheave, which elevator further includes a compensation rope in the lower shaft area between the car and the counterweight, which compensation rope runs around a compensation sheave arrangement in the shaft bottom, which elevator has a compensation device for the compensation of rope elongation. The compensation device includes a diverting pulley for the compensation rope connected to the counterweight, whereby the compensation rope is arranged to run over the diverting pulley, a tension weight connected with the free end of the compensation rope, a rope clamp arranged on the compensation rope and a clamp support for connecting the rope clamp to the counterweight. A compensation device is provided for the rope elongation which necessitates less vertical space in the elevator shaft.

19 Claims, 4 Drawing Sheets

(51) Int. Cl.
*B66B 7/10* (2006.01)
*B66B 11/00* (2006.01)

(56) References Cited

U.S. PATENT DOCUMENTS

| | | | | |
|---|---|---|---|---|
| 2,270,441 | A | 1/1942 | Hymans | |
| 4,522,285 | A | 6/1985 | Salmon et al. | |
| 5,513,724 | A | 5/1996 | De Jong | |
| 2017/0144861 | A1 * | 5/2017 | Hafele | B66B 7/10 |

FOREIGN PATENT DOCUMENTS

| | | | | |
|---|---|---|---|---|
| EP | 0731052 | A1 * | 9/1996 | B66B 7/06 |
| EP | 2492232 | A1 * | 8/2012 | B66B 7/068 |
| JP | 06100273 | A * | 4/1994 | B66B 7/06 |
| JP | 2004-338831 | A | 12/2004 | |
| WO | WO-2010023350 | A1 * | 3/2010 | B66B 7/10 |

* cited by examiner

ELEVATOR

This application is a Continuation of PCT International Application No. PCT/EP2013/061373, filed on Jun. 3, 2013, which claims priority under 35 U.S.C. 119(a) to Patent Application No. 12173,201.0, filed in the Europe on Jun. 22, 2012, all of which are hereby expressly incorporated by reference into the present application.

The present invention relates to an elevator having an elevator car and a counterweight suspended and/or driven by hoisting ropes, which hoisting ropes are driven by a drive machine via a traction sheave. The elevator further comprises a compensation rope between the car and the counterweight in the lower shaft area, which compensation rope runs around a compensation sheave arrangement in the shaft bottom. Finally, the elevator has a compensation device for the compensation of rope elongation.

Elevators with a compensation rope are particularly high rise elevators or elevators which are travelling at a very high speed (which are always also high rise elevators or tower elevators where a large distance of e.g. more than 100 meter has to be travelled in a very short time). In these elevators a compensation rope is necessary as without compensation ropes an imbalance would occur with the hoisting rope weight in the extreme positions of the elevator car. For example in a tower of 300 meters height the weight of the hoisting ropes may sum up to tons, which load is arranged on one side of the traction sheave in the upper most or lower most position of the elevator car. On this behalf, compensation ropes with about the same weight as the hoisting ropes are provided. The compensation ropes allow the maintenance of a certain tension in the roping system which now builds a closed loop with following components: elevator car-hoisting rope-counterweight-compensation rope-elevator car. Generally, the compensation rope which is fixed at the car and counterweight runs over a compensation rope sheave arrangement located in the shaft bottom.

Figure 1:
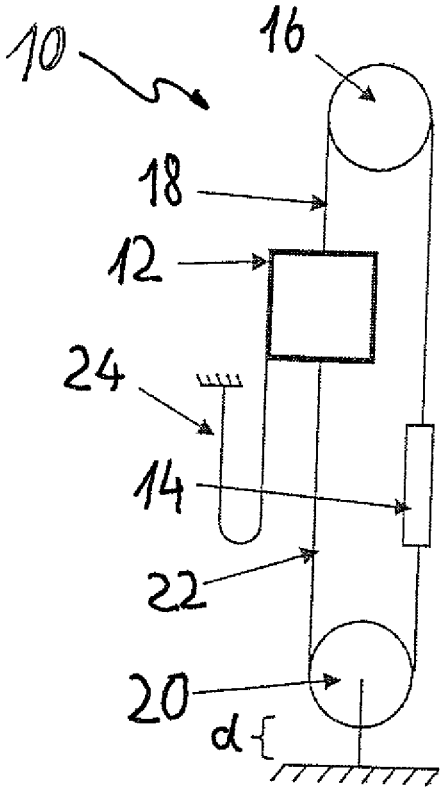

Such kind of elevator is shown in FIG. 1 of the present invention. This traction sheave elevator 10 has got an elevator car 12, a counterweight 14, an upper traction sheave 16 driven by a drive machine (not shown) which traction sheave 16 co-acts via friction with hoisting ropes 18 fixed to the elevator car 12 and the counterweight 14. Furthermore, in the shaft bottom a compensation sheave arrangement 20 is provided around which a compensation rope 22 runs which is connected to the bottom of the elevator car 12 and the counterweight 14. Furthermore, the elevator car is connected to the elevator control via a travelling cable 24 which is fixed to the elevator shaft, which travelling cable 24 provides the power and control supply for the elevator car 12. Generally, the compensation sheave arrangement 20 comprises a compensation device for the rope elongation which is usually arranged in a way that the compensation sheave of the compensation sheave arrangement 20 is biased via a spring or weight loaded biasing means over the stroke d to the shaft bottom. This arrangement necessitates together with the necessary play d for rope elongation an essential vertical height in the elevator shaft.

It is object of the present invention to provide an elevator which needs less vertical space than known solutions.

The inventions solves this object with an elevator according to claim 1 and with a method for maintaining the rope tension in a compensation rope of an elevator according to claim 12. Preferred embodiments of the invention are subject matter of the dependent claims.

According to the invention the compensation device of the elevator is totally rearranged with respect to the known solution. According to the invention a diverting pulley for the compensation rope is connected to the counterweight whereby the compensation rope is arranged to run over the diverting pulley. Furthermore, a tension weight is connected with the free end of the compensation rope on the side of the counterweight. This tension weight is arranged in a comparably short distance from the diverting pulley so as to avoid any undue increase of the counterweight length with the tension weight. Anyway, as the tension weight sums up to the weight of the counterweight it is possible to shorten the counterweight accordingly. Furthermore, a rope clamp is arranged on the compensation rope before the compensation rope runs on the diverting pulley of the compensation device. This rope clamp is fixed to a clamp support provided at the counterweight for supporting the rope clamp.

If the compensation rope becomes slack because of rope elongation the following tightening procedure can be easily be carried out. Preferably, the counterweight is driven to an adjustment position below lowest floor, preferably to its lower most position. In this adjustment position the rope clamp is opened so that the slackened compensation rope is tightened by the tension weight which is pulling the compensation rope over the diverting pulley. After this tensioning step the rope clamp is locked or tightened again and the elevator can be put back into use. This compensation device for the rope elongation has the advantage that it does not take any vertical height in the shaft bottom, particularly in the area of the compensation sheave arrangement.

Furthermore, the usual tension weights needed in connection with the compensation sheave arrangement can now be omitted. The mass needed to produce the same amount of tension can be halved with respect to current solutions and this mass is simultaneously acting as counterweight mass. This means that with the invention about 1000 kg of steel weight can be omitted in the elevator.

The opening and closing or locking of the rope clamp on the compensation rope can be done manually by a maintenance person e.g. in course of a maintenance cycle or automatically with an operating means which is configured to open and close said rope clamp on the compensation rope. The operating means is preferably an electrically driven apparatus which is able to open and lock the rope clamp on the compensation rope. Preferably, the operating means is provided in connection with the above mentioned adjustment position at the lower shaft end. The operating means can be controlled by the elevator control and/or in response to the signal of a monitoring device for the rope tension as described hereinafter or manually, e.g. by control buttons in the machine room.

According to a preferred embodiment of the invention a monitoring device is provided which monitors the rope tension of the compensation rope and outputs a tension signal to the elevator control to inform a maintenance center and/or to operate the above mentioned operating means. The monitoring device can be located at any place where the tension of the compensation rope can be measured, e.g. at the car, at the counterweight or in connection with the compensation sheave arrangement. The latter placement of the monitoring device in connection with the compensation sheave arrangement is the best solution because in this case the position of the monitoring device is fixed in the shaft and is not travelling together with the elevator car or counterweight. Accordingly, the monitoring device can be better connected and maintained as when connected to a travelling elevator component. The tension can e.g. be measured via a device which measures the tension acting on the compensation sheave or sheaves. This could be e.g. an electromechanical transducer provided between the bearing of the compensation sheave and the frame of the compensation sheave arrangement. Alternatively, a buffer can be provided for the mounting of the bearing of the compensation sheaves at the frame. In this case also the play or the position of the bearing of the compensation sheave can be measured to retrieve information about the tension of the compensation rope. The activation of the operating means can be triggered preferably if a certain threshold value for the rope tension or an actual output signal of the monitoring device is exceeded. Instead of actual signals also a certain integrated value can be used to avoid the activation of the operating means in case of short peaks, e.g. in case of an emergency stop of the elevator car. The integration time may extend from several seconds to several minutes or hours.

In a preferred embodiment of the invention an adjustment means can be provided in connection with the clamp support which is configured to adjust the distance of the rope clamp from the counterweight. Such an adjustment means may e.g. be a hollow spindle which is carried by a clamp support base whereby the fixing point for the rope clamp is located at the free end of the hollow spindle and this free end can be adjusted with respect to the clamp support base by turning the spindle or an adjustment nut provided in connection with the clamp support base. Also a lot of other solutions may be provided as adjusted means, e.g. hydraulic means or an electrical actuator, e.g. rack and pinion device. The advantage of the adjustment means is the fact that the rope elongation can be compensated in a certain range with the variation of the position of the rope clamp with respect to the counterweight by correspondingly controlling the adjustment means. Thus in the beginning the adjustment means is adjusted to provide the largest distance of the rope fixing point to the counterweight. With increasing rope elongation the adjustment means reduces the distance of the fixing point from the counterweight in which case the rope will be tightened. Only if the stroke of the adjustment means is at its end the rope clamp has to be loosened and tightened after the tension weight has drawn the compensation rope into tension. During this tightening step also the adjustment means can be driven to its initial position with the largest distance of the rope fixing point from the counterweight.

Preferably, also the adjustment means is controlled via the monitoring device. Preferably, the inventive elevator is provided for high rise elevators, i.e. for elevators with a shaft height above 50 meters, preferably above 100 meter. Also the invention can be provided for elevators with a high travel velocity of more than 3.4 meter per second. This means that the invention can also be provided for tower elevators or elevators in industrial plants, e.g. wind mills to get into a high mounting position.

Preferably, the adjustment means also has a determination means for the adjustment position of the adjustment means so that the operating means can also be triggered when the compensation rope is still tight but the play of the adjustment means is at its end.

Furthermore, the signal of the determination means can be used to check via the elevator control whether a slackening of the compensation rope detected by the monitoring device can be compensated by adjusting the adjustment means accordingly.

Thus, the combination of monitoring device, adjustment means, operating means and determination means offers a kind of best solution to handle rope elongations with a minimum of effort and a minimum space requirement particularly in the vertical direction of the elevator shaft.

It shall be clear that the hoisting rope as well as the compensation rope regularly comprises a set of parallel independent ropes or belts.

The method for maintaining the rope tension of compensation rope may be as follows:

The tension of the compensation is monitored by the monitoring device. In case the actual or integrated tension signal of the monitoring device shows a slackening of the compensation rope tension the elevator is put out of operation and the counterweight is driven to a low position, preferably to its lower most position where either an operating means is located which opens and tightens the rope clamp on the compensation rope or where a person opens and tightens the rope clamp manually. With the opening of the rope clamp the tension weight draws the compensation rope over the diverting pulley and tightens it. Hereinafter the rope clamp is tightened either automatically by the operating means or manually via the maintenance person. After tightening the rope clamp the elevator is put back to operation. If an adjustment means is provided which is able to vary the vertical distance of the rope clamp from the counterweight in response to the signal of the monitoring device the adjustment means can be actuated so as to keep the compensation rope tightened, e.g. such that the tension does not fall under a threshold value. In this case the operating means only needs to be triggered when the adjustment range of the adjustment means is at its end.

The adjustment means is preferably activated electrically. In this case the drive of the adjustment means can be provided in connection with the counterweight or the drive of the adjustment means can be located in the shaft bottom so that the operation of the adjustment means is only possible when the counterweight is driven to its lower most position where the adjustment means is located adjacent its drive.

Preferably, also the operation of the operating means, of the adjustment means and of the monitoring device as well as the determination means is controlled by the elevator control. Alternatively, also a separate control can be provided for all these components. Anyway, also this separate control has to co-act with the elevator control as the counterweight has always to be driven to its lower most position before opening and tightening the rope clamp on the compensation rope.

In a preferred embodiment of the invention which necessitates less vertical space a compensation rope with a very small diameter is used which is preferably less than 8 millimeter or particularly less than 6 millimeter in which case very small diverting pulleys can be used in the compensation device. This reduces the height of the counterweight as the diameter of the diverting pulleys of the compensation device can be reduced accordingly. Regulations provide for a ratio of the rope diameter to the pulley diameter of 1 to 40. In case of small compensation rope diameters several small diverting pulleys can be located side by side on the counterweight in which case several separate tension weights can be used.

In a preferred embodiment a rope reel can be used as tension weight in which case the excessive compensation rope which is fed out behind the rope clamp can be wound to the rope reel so that the tensioning of the compensation rope does not lead to a larger distance of the tension weight (rope reel) to the diverting pulley. Also this measure therefore reduces the vertical space requirement of the compensation device at the lower end of the counterweight.

The different embodiments of the invention mentioned above can be combined arbitrarily as long as this is technically possible.

Hereinafter the invention is described schematically with the aid of the enclosed drawings.

Figure 2:
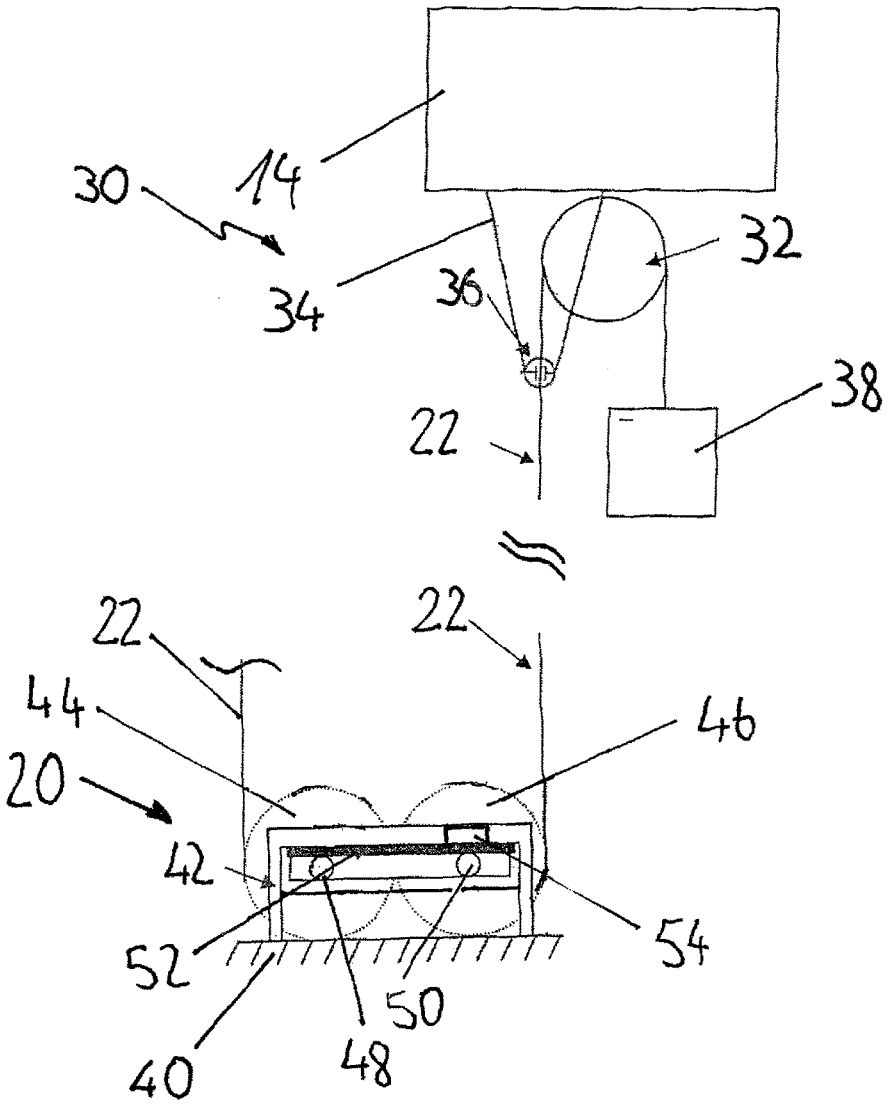
Figure 3:
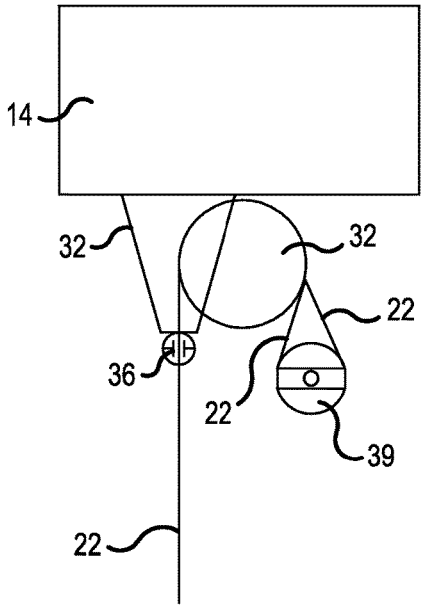
Figure 4:
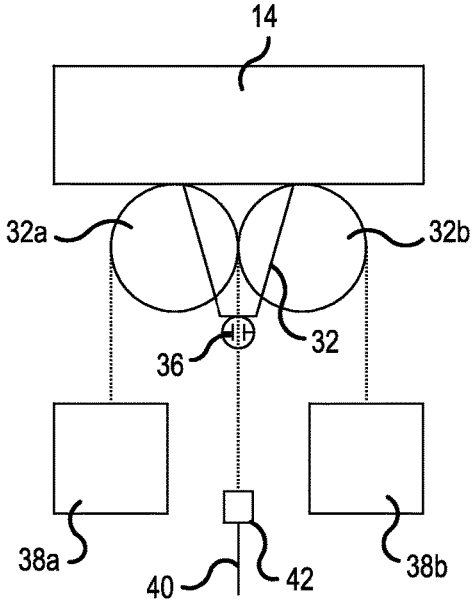
Figure 5:
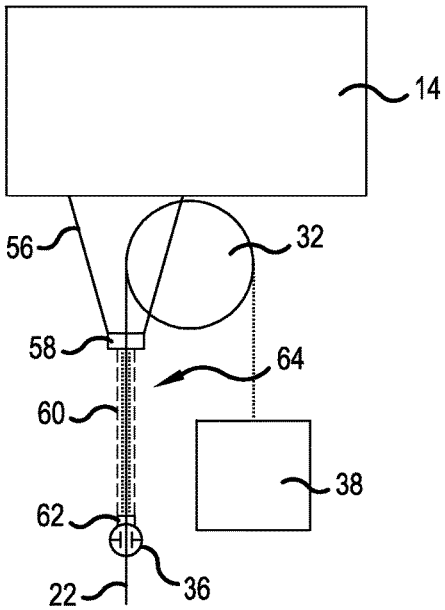
Figure 6:
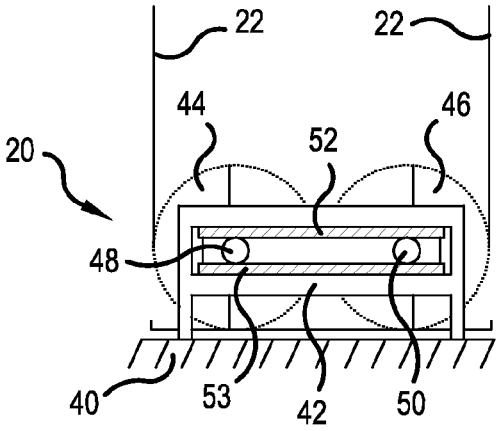
Figure 7:
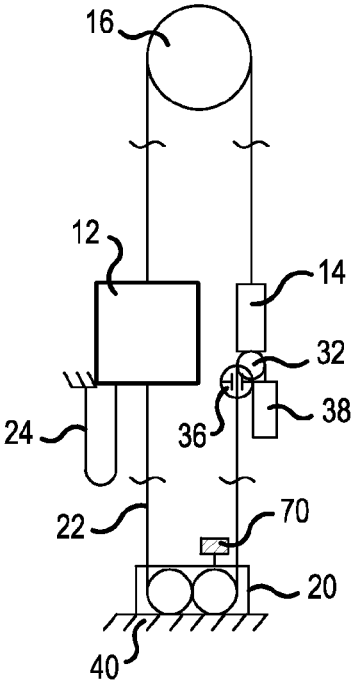
Figure 8:
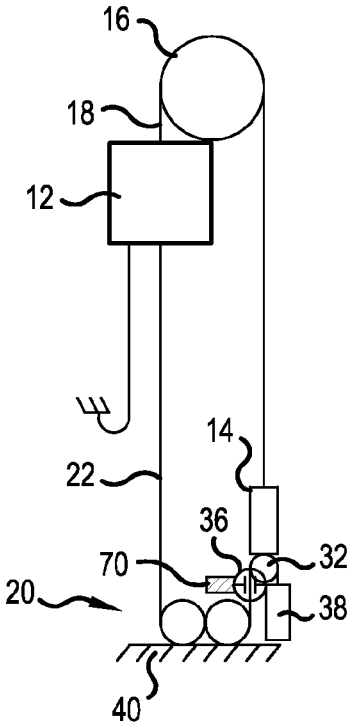

FIG. 1 is a traction sheave elevator with a compensation rope according to the background art, FIG. 2 shows a schematic drawing of a first embodiment of the invention with compensation device mounted to a counterweight, FIG. 3 an embodiment according to FIG. 2 where the tension weight of the compensation device is replaced by a rope reel, FIG. 4 an embodiment according to FIG. 2 where a compensation device with two diverting pulleys and two tension weights is used in connection with thin compensation ropes, FIG. 5 shows an embodiment with a counterweight having a compensation device with a diverting pulley, a tension weight, a rope clamp and an adjustment means for adjusting the distance between the rope clamp and the counterweight, FIG. 6 shows a second embodiment of a compensation sheave arrangement in the shaft bottom, FIG. 7 shows a schematic drawing of an elevator with a compensation device having an operating means for opening and tightening the rope clamp on the compensation rope, and FIG. 8 the arrangement of FIG. 7 with the during a tensioning step where the operating means opens and closes the rope clamp during the tensioning of the compensation rope.

Identical or functional similar parts in the prior art drawing of FIG. 1 and the other figures are designated with the same reference numbers.

FIG. 2 shows the inventive compensation device 30 having a diverting pulley 32 mounted at the bottom of the counterweight with a (not shown) support as well as with a rope clamp support 34 mounted also on the bottom of the counterweight 14. To the lower end of the rope clamp support 34 a rope clamp 36 is which is clamped on the compensation rope 22. The end of the compensation rope 22 exceeding the rope clamp 36 runs over the diverting pulley 32 and is connected to a tension weight 38.

In the shaft bottom 40 the compensation sheave arrangement 20 is provided comprising a frame 44 on which two compensation sheaves 44, 46 are rotatable pivoted on bearings 48, 50. These bearings 48, 50 are mounted in horizontally fixed positions. Anyway they are movable with a play in direction to the shaft top via a dampening layer 52. This layer is made of an elastic material allowing a certain vertical play of the bearing 48, 50 in the upper direction dependent on the rope tension acting on the compensation sheaves. On the upper part of the frame a monitoring device 54 is provided in the form of a distance sensor which measures the distance of the bearing 50 to the monitoring device. Via this measurement the rope tension can be determined.

FIG. 3 shows nearly the same arrangement of the compensation device as in FIG. 2 but in FIG. 3 instead of a tensioning weight a rope reel 39 is used. This has the effect that the compensation rope 22 which is set free in course of a tightening step because of the rearrangement of the rope clamp does not lead to a larger distance of the tension weight 38 to the counterweight 14 but is wound on the rope reel 39. Accordingly, this arrangement has a very low vertical space requirement.

The same holds true for the embodiment of FIG. 4 where instead of one diverting pulley two diverting pulleys 32 *a*, 32 *b* are used as well as two tension weights 38 *a*, 38 *b*. The special advantage of this embodiment is the use of a compensation rope 40 with a very small diameter of less than 8 mm or even less than 6 mm. This allows the use of correspondingly small diverting pulleys 32 *a*, 32 *b* thus reducing the vertical dimension of the compensation device below the counterweight 14. In this embodiment also a rope termination 42 is used to limit the stroke along which the rope elongation can be compensated.

FIG. 5 shows an embodiment which is nearly identical to FIG. 2 with the difference that in this embodiment an adjustment means 64 is used for supporting the rope clamp 36 with a variable distance on a clamp support base 56. In this embodiment a rotatable nut 58 holds a spindle 60 having on its lower free end 62 *a* support for the rope clamp 36. Via operation of the nut 58 the distance of the lower supporting end 62 of the spindle 60 from the rope clamp support base 56 can be adjusted. Via that adjustment means 64 *a* certain rope elongation can be compensated.

The operation of the adjustment means 64 can be provided e.g. controlled by the signals of the monitoring device 54 in FIG. 2. The rotatable nut 58 can be provided with a rotation drive which allows automatic compensation of the rope tension. The drive may be provided with the counterweight or in the shaft bottom. In the latter case the operation of the adjustment means is only possible in an adjustment position of the counterweight at or near the shaft bottom FIG. 6 shows another embodiment of a compensation sheave arrangement 20. In contrast to the compensation sheave arrangement 20 of FIG. 2 this embodiment has also a second dampening layer 53 below the bearings 48, 50 of the compensation sheaves 44, 46. Accordingly, this arrangement allows a certain play of the bearings 52, 50 in both vertical directions up and down according to the current tension of the compensation rope 22.

FIGS. 7 and 8 show the operation of the compensation device in an automated embodiment of the invention.

In FIG. 7 the elevator is shown during operation. When the elevator control determines—based on the signals of a monitoring device, e.g. the monitoring device 54 from FIG. 2—that a lower threshold value for the compensation rope tension is exceeded the elevator is taken out of operation and the elevator control drives the counterweight 14 to an adjustment position in a lower part of the elevator shaft near the shaft bottom. In this position an operating means 70 is activated by the control to open the rope clamp 36. After the rope clamp 36 has been opened the tension weight 38 pulls the slackened compensation rope 22 over the diverting pulley so that the compensation rope is tightened again. Then the operating means 70 locks the rope clamp 36 on the compensation rope and the elevator is taken back into operation.

As it may be seen particularly in FIGS. 2, 6, 7 and 8 the compensation sheave arrangement can be provided such that there is only a minor gap between the compensation sheaves 44 and 46 and the shaft bottom 40. This reduces the vertical height with respect to prior art solutions where the compensation device was provided in the compensation sheave arrangement and thus the complete play of the rope elongation had to be provided additionally between the compensation sheaves 44 and 46 and the shaft bottom 40.

The different embodiments mentioned above can be combined arbitrarily as long as this is technically possible. The invention can be varied within the scope as defined by the enclosed claims.

The invention claimed is:

1. An Elevator, comprising an elevator car;

a counterweight suspended by hoisting ropes, the hoisting ropes being driven by a drive machine via a traction sheave;

a compensation rope in a lower shaft area between the car and the counterweight, the compensation rope running around a compensation sheave arrangement in the shaft bottom;

a compensation device for the compensation of rope elongation, the compensation device comprising:

a diverting pulley for the compensation rope connected to the counterweight, whereby the compensation rope is arranged to run over the diverting pulley;

a tension weight connected with a free end of the compensation rope;

a rope clamp arranged on the compensation rope; and a clamp support for connecting the rope clamp to the counterweight, wherein the elevator is a high rise elevator provided with at least one of a shaft height of more than 50 m and a velocity of more than 3.5 m/s.

2. The elevator according to claim 1, further comprising an operating device configured to open and close the rope clamp on the compensation rope.

3. The elevator according to claim 2, wherein the operating device is configured to be operated only at a counterweight position below the lowest landing of the elevator.

4. The elevator according to claim 3, wherein the clamp support comprises an adjustment device configured to adjust the distance of the rope clamp from the diverting pulley.

5. The elevator according to claim 3, wherein a monitoring device is provided which monitors the rope tension of the compensation rope and outputs a tension signal to a control for operating at least one of the adjustment device and the operating device.

6. The elevator according to claim 2, wherein the clamp support comprises an adjustment device configured to adjust the distance of the rope clamp from the diverting pulley.

7. The elevator according to claim 2, wherein a monitoring device is provided which monitors the rope tension of the compensation rope and outputs a tension signal to a control for operating at least one of the adjustment device and the operating device.

8. The elevator according to claim 2, wherein the compensation sheave arrangement comprises a frame with a bearing for at least one compensation sheave.

9. The elevator according to claim 1, wherein the clamp support comprises an adjustment device configured to adjust the distance of the rope clamp from the diverting pulley.

10. The elevator according to claim 9, wherein a monitoring device is provided which monitors the rope tension of the compensation rope and outputs a tension signal to a control for operating at least one of the adjustment device and the operating device.

11. The elevator according to claim 1, wherein a monitoring device is provided which monitors the rope tension of the compensation rope and outputs a tension signal to a control for operating at least one of the adjustment device and the operating device.

12. The elevator according to claim 11, wherein the monitoring device is provided in connection with the compensation sheave arrangement.

13. The elevator according to claim 11, wherein the monitoring device is provided for monitoring the vertical play of the bearing.

14. The elevator according to claim 1, wherein the compensation sheave arrangement comprises a frame with a bearing for at least one compensation sheave.

15. The elevator according to claim 14, wherein the bearing is mounted in the frame with a dampening or spring mechanism allows a small vertical play of the bearing for the compensation of tension changes in the compensation rope.

16. The elevator according to claim 1, wherein the tension weight is a rope reel.

17. A method for maintaining the rope tension in a compensation rope of the elevator according to claim 1, said method comprising the steps of:

monitoring the tension of the compensation rope; and in response to the tension signal, actuating an operating device in a lower part of the elevator shaft to open and close a rope clamp, which is provided in connection with a counterweight of the elevator, so that the compensation rope is able to be tensioned by a tension weight provided in connection with the counterweight.

18. The method according to claim 17, further comprising the step of measuring the tension of the compensation rope in connection with a compensation sheave arrangement at the shaft bottom.

19. The method according to claim 17, further comprising the steps of:

issuing a low tension with a monitoring device when the tension of the compensation rope falls under a set threshold value;

after receiving a low tension signal, taking the elevator out of operation with a control of the elevator and driving the counterweight to an operating position below the lowest landing, landing;

activating the operating device to open the rope clamp;

tightening the compensation rope with the tension weight;

activating the operating device to close the rope clamp; and taking the elevator back into operation.

* * * * *